US010415823B2

(12) United States Patent
Acosta Herrero et al.

(10) Patent No.: US 10,415,823 B2
(45) Date of Patent: Sep. 17, 2019

(54) BURNER COVER AND GAS BURNER

(71) Applicant: BSH Hausgeräte GmbH, Munich (DE)

(72) Inventors: Luis Acosta Herrero, Maliaño (ES); Javier Corral Ricalde, Muriedas (ES); Melca Gutierrez Humara, La Penilla (ES); Pedro Herrera Estrada, Santander (ES); Alberto Lopez Ortiz, Santander (ES); Jose Salvador Ochoa Torres, El Astillero (ES); Luis Antonio Palacios Valdueza, Astillero (ES); Emilio Placer Maruri, Liencres (ES)

(73) Assignee: BSH Hausgeräte GmbH, Munich (DE)

( * ) Notice: Subject to any disclaimer, the term of this patent is extended or adjusted under 35 U.S.C. 154(b) by 193 days.

(21) Appl. No.: 15/559,085

(22) PCT Filed: Mar. 2, 2016

(86) PCT No.: PCT/IB2016/051161
§ 371 (c)(1),
(2) Date: Sep. 18, 2017

(87) PCT Pub. No.: WO2016/157003
PCT Pub. Date: Oct. 6, 2016

(65) Prior Publication Data

US 2018/0073731 A1 Mar. 15, 2018

(30) Foreign Application Priority Data

Mar. 31, 2015 (ES) ..... 201530437

(51) Int. Cl.
*F23D 14/06* (2006.01)
*F24C 3/08* (2006.01)

(52) U.S. Cl.
CPC ..... *F23D 14/06* (2013.01); *F23D 14/065* (2013.01); *F24C 3/08* (2013.01); *F23D 2900/14062* (2013.01); *F23D 2900/14063* (2013.01)

(58) Field of Classification Search
CPC ..... F23D 14/06; F23D 2800/14; F24D 3/08
(Continued)

(56) References Cited

U.S. PATENT DOCUMENTS 5,690,483 A 11/1997 Oda et al.
6,095,802 A 8/2000 Kwiatek
(Continued)

FOREIGN PATENT DOCUMENTS

DE 1950506 A1 4/1971
EP 1512908 A1 3/2005
(Continued)

OTHER PUBLICATIONS

National Search Report CN 201680019858 dated Nov. 1, 2018.
International Search Report PCT/IB2016/051161 dated Jun. 15, 2016.

*Primary Examiner* — Gregory L Huson
*Assistant Examiner* — Nikhil P Mashruwala
(74) *Attorney, Agent, or Firm* — Michael E. Tschupp; Andre Pallapies; Brandon G. Braun

(57) ABSTRACT

A burner cover for a gas burner includes a disk-shaped base segment, and an annular gas distribution segment which is connected to the base segment. The gas distribution segment has first gas distribution channels, which extend radially from an inner surface of the gas distribution segment toward an outer edge of the base segment. Each first gas distribution channel extends through the gas distribution segment and has a T-shaped cross-sectional geometry, which is open in a direction pointing away from the base segment.

17 Claims, 13 Drawing Sheets

(58) Field of Classification Search
USPC ..... 126/39 E, 39 R
See application file for complete search history.

(56) References Cited

U.S. PATENT DOCUMENTS

| | | | | |
|---|---|---|---|---|
| 6,371,754 | B1 * | 4/2002 | Haynes | F23D 14/06 239/567 |
| 8,747,108 | B2 * | 6/2014 | Lona Santoyo | F23D 14/06 126/39 B |
| 9,151,494 | B2 | 10/2015 | Quintaba et al. | |
| 2017/0370576 | A1 * | 12/2017 | Fang | F23D 14/58 |
| 2018/0045406 | A1 * | 2/2018 | Wang | F23D 14/04 |
| 2018/0106476 | A1 * | 4/2018 | Breccia | F24C 3/082 |

FOREIGN PATENT DOCUMENTS

| | | | |
|---|---|---|---|
| EP | 2053309 | A1 | 4/2009 |
| FR | 461634 | A | 1/1914 |

* cited by examiner

BURNER COVER AND GAS BURNER

CROSS-REFERENCES TO RELATED APPLICATIONS

This application is the U.S. National Stage of International Application No. PCT/IB2015/066911, filed Mar. 2, 2016, which designated the United States and has been published as International Publication No. WO 2016/157003 A1 and which claims the priority of Spanish Patent Application, Serial No. P20153043, filed Mar. 31, 2015, pursuant to 35 U.S.C. 119(a)-(d).

BACKGROUND OF THE INVENTION

The invention relates to a burner cover for a gas burner and a gas burner for a domestic cooking appliance.

Gas burners for domestic cooking appliances comprise a lower section, which may be attached to a cooktop, and a burner cover, which can be placed over the lower section of the burner. A mixing space, in which fuel gas mixes with primary air, is provided between the lower section of the burner and the burner cover. The burner cover has radially arranged gas distribution channels, which are arranged so as to distribute the fuel gas/air mixture evenly.

BRIEF SUMMARY OF THE INVENTION

Against this background, one object of the invention consists in providing an improved burner cover for a gas burner.

A burner cover for a gas burner is proposed accordingly. The burner cover comprises a disk-shaped base segment and an annular gas distribution segment connected to the base segment, wherein the gas distribution segment comprises first gas distribution channels, which extend radially from an inner surface of the gas distribution segment toward an outer edge of the base segment, wherein each first gas distribution channel extends through the gas distribution segment and has a T-shaped cross-sectional geometry, which is open in the direction pointing away from the base segment.

The T-shaped cross-sectional geometry of the gas distribution channels enables the overall height of the burner cover to be reduced in comparison to known rectangular gas distribution channels. The gas burner can have a flatter design as a result. A flat gas burner design is particularly advantageous in gas stoves with gas burners arranged on a ceramic glass top. Despite the reduced overall height of the gas burner, the T-shaped cross-sectional geometry results in improved efficiency in comparison to known burner covers with rectangular gas distribution channels. The air/fuel gas mixture flows out particularly evenly thanks to the T-shaped cross-sectional geometry. Carbon monoxide and soot emissions are reduced as a result. The gas distribution channels are advantageously arranged so that they run obliquely upward toward the base segment of the burner cover. The flame angle thereby achieved further improves the efficiency of the gas burner. The base segment is advantageously circular. In particular, the base segment and the gas distribution segment are configured as a single piece.

According to one embodiment, the T-shaped cross-sectional geometry has a horizontal section and a vertical section, the horizontal section being open in the direction pointing away from the base segment.

The open end of the T-shaped cross-sectional geometry is closed in the figurative sense by an upper edge of the lower section of the burner when the burner cover is placed over a lower section of the burner, so that a T-shaped gas outlet is defined by each gas distribution channel and the upper edge. A mixing space, in which the fuel gas is mixed with primary air, is available between the burner cover and the lower section of the burner. The gas distribution segment ensures the even distribution of the fuel gas/air mixture.

According to a further embodiment, the horizontal section is 1.5 to 6 times, preferably 2 to 5 times, more preferably 2.5 to 4 times as wide as the vertical section.

The gas distribution channels can be milled into the gas distribution segment. Alternatively, the gas distribution channels may be incorporated into the gas distribution segment by means of a molding process, such as pressure casting, for example.

According to a further embodiment, the vertical section extends into the gas distribution segment 1.5 to 6 times, preferably 2 to 5 times, and more preferably 2.5 to 4 times as deeply as the horizontal section does.

The first gas distribution channel advantageously traverses the gas distribution segment across its entire thickness.

According to a further embodiment, the first gas distribution channels are arranged so as to be evenly distributed around a periphery of the gas distribution segment.

The first gas distribution channels advantageously run obliquely from the inner surface of the gas distribution segment toward the outer edge of the base segment.

According to a further embodiment, the inner surface of the gas distribution segment is inclined obliquely to the base segment.

This enables the fuel gas/air mixture to flow particularly easily into the gas distribution channels. For example, the inner surface is inclined at an angle of 40° to 45° relative to the central section of the base segment.

According to a further embodiment, the burner cover has a circumferential groove, which runs around the gas distribution segment.

The circumferential groove may for example have a quadrant-shaped cross-sectional geometry. The vertical section of the T-shaped gas outlet advantageously opens into the circumferential groove. This causes the outflow speed of the air/fuel gas-mixture to be modified.

According to one embodiment, the burner cover has positioning elements for positioning the burner cover onto a lower section of the gas burner, the positioning elements extending out of the gas distribution segment in the direction pointing away from the base segment.

In particular, the positioning elements extend out of an upper surface of the gas distribution segment. Receiving sections are preferably provided in the lower section of the burner for receiving the positioning elements. This makes it possible for the positioning of the burner cover over the lower section of the burner to be defined.

According to a further embodiment, the positioning elements are wedge-shaped. This makes it possible for the burner cover to be centered exactly over the lower section of the burner. Alternatively, the positioning elements may be frusto-conically shaped According to a further embodiment, an upper surface of the gas distribution segment is inclined toward the outer edge of the base segment.

For example, the outer section of the base segment is inclined toward the outer edge. The upper surface may be arranged parallel to the outer section. For example, the upper surface is inclined at an angle of 10° to 15°. The gas distribution channels are preferably positioned parallel to the upper surface.

According to a further embodiment, the burner cover has second gas distribution channels, which extend radially from the inner surface of the gas distribution segment toward the outer edge of the base segment, wherein each second gas distribution channel extends through the gas distribution segment and has a semi-circular cross-sectional geometry, which is open in the direction pointing away from the base segment.

A respective gas outlet of the second gas distribution channels is defined by the semi-circular cross-sectional geometry and the upper edge of the lower section of the burner. An outflow cross-section of the second gas distribution channels is preferably smaller than an outflow cross-section of the first gas distribution channels.

According to a further embodiment, each second gas distribution channel extends through a bridge of the gas distribution segment, said bridge being provided between two first gas distribution channels.

Side walls of the two first gas distribution channels adjacent to the bridge are preferably designed in a rounded fashion.

According to a further embodiment, the second gas distribution channels are arranged so as to be evenly distributed around a periphery of the gas distribution segment and positioned opposite one another in pairs.

For example, four second gas distribution channels are provided. In particular, a second gas distribution channel is arranged adjacently to an ignition element of the gas burner. As a result of this a reliable ignition can always be achieved.

Furthermore, a gas burner for a domestic cooking appliance is proposed with a lower section and a burner cover of this type placed over the lower section of the burner.

The domestic cooking appliance may for example be a gas stove or a gas cooktop.

Further possible implementations of the burner cover and/or of the gas burner also comprise combinations, not explicitly specified, of the features or embodiments described above or below with regard to the exemplary embodiments, wherein a person skilled in the art will also add individual aspects as improvements of or extensions to the respective basic form of the burner cover and/or of the gas burner.

BRIEF DESCRIPTION OF THE DRAWINGS

Further advantageous embodiments and aspects of the burner cover and/or of the gas burner form the subject matter of the subclaims and of the exemplary embodiments described below of the burner cover and/or of the gas burner. The burner cover and/or the gas burner are explained in greater detail below on the basis of preferred embodiments with reference to the attached diagrams.

DETAILED DESCRIPTION OF EXEMPLARY EMBODIMENTS OF THE PRESENT INVENTION

Figure 1:
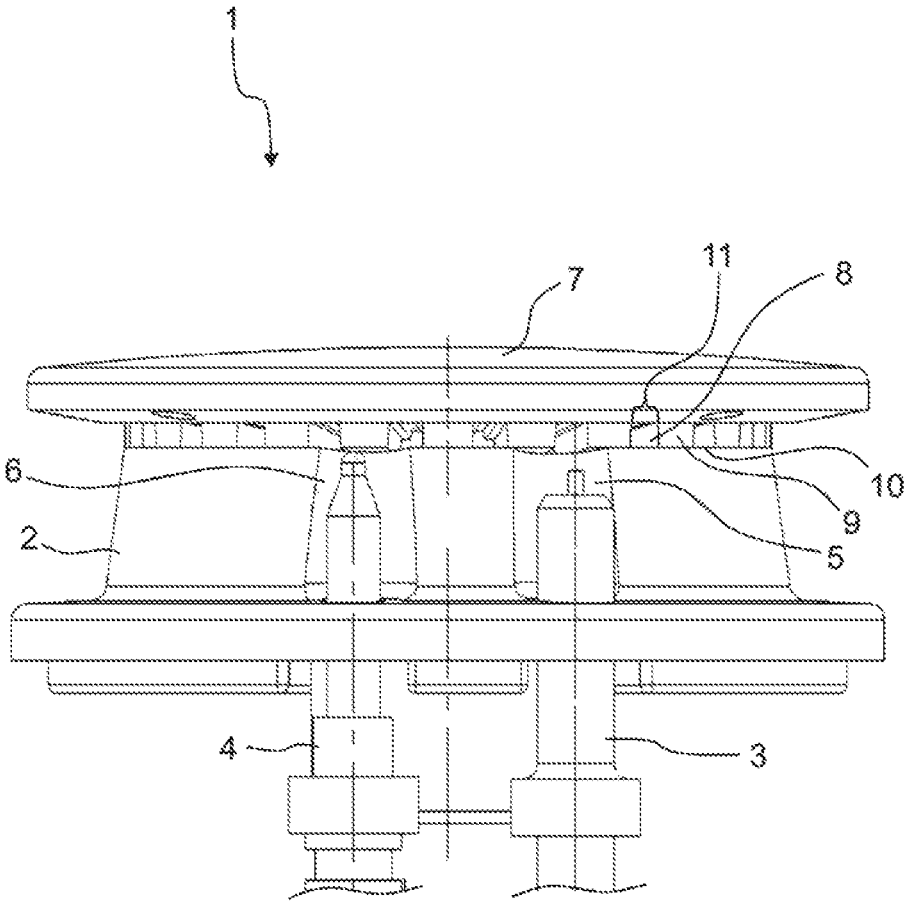
FIG. 1 shows a schematic lateral view of an embodiment of a gas burner.

In the figures, elements that are identical or functionally identical are assigned the same reference characters unless otherwise specified.

FIG. 1 shows a schematic lateral view of an embodiment of a gas burner 1 for a domestic cooking appliance. The domestic cooking appliance may for example be a gas stove or a gas cooktop. The gas burner 1 comprises a lower section 2, which can be fastened to a cooktop of the domestic cooking appliance. The lower section 2 of the burner is for example manufactured from an aluminum or magnesium material. The lower section 2 of the burner may in particular be a die-cast aluminum component. The gas burner 1 further comprises an ignition element 3 for igniting a fuel gas/air mixture and a thermal element 4 for flame monitoring. The thermal element 4 is connected to a gas shut-off valve of the gas burner 1 in such a way that the gas shut-off valve interrupts the gas flow to the gas burner 1 if a burner flame of the gas burner 1 is extinguished. The ignition element 3 and the thermal element 4 may be accommodated in receiving sections 5, 6 of the lower section 2 of the burner.

The gas burner 1 further comprises a burner cover 7, which is placed over the lower section 2 of the burner. The burner cover 7 may in particular be lifted off the lower section 2 of the burner. The burner cover 7 has first gas distribution channels 8, which are provided in a gas distribution segment 9 of the burner cover 7. The burner cover 7 may be manufactured from an aluminum or ferrous material. The gas distribution segment 9 rests on an upper edge 10 of the lower section 2 of the burner. Gas outlets 11 of the gas burner 1 are defined by the first gas distribution channels 8 and the upper edge 10 of the lower section 2 of the burner.

Figure 2:
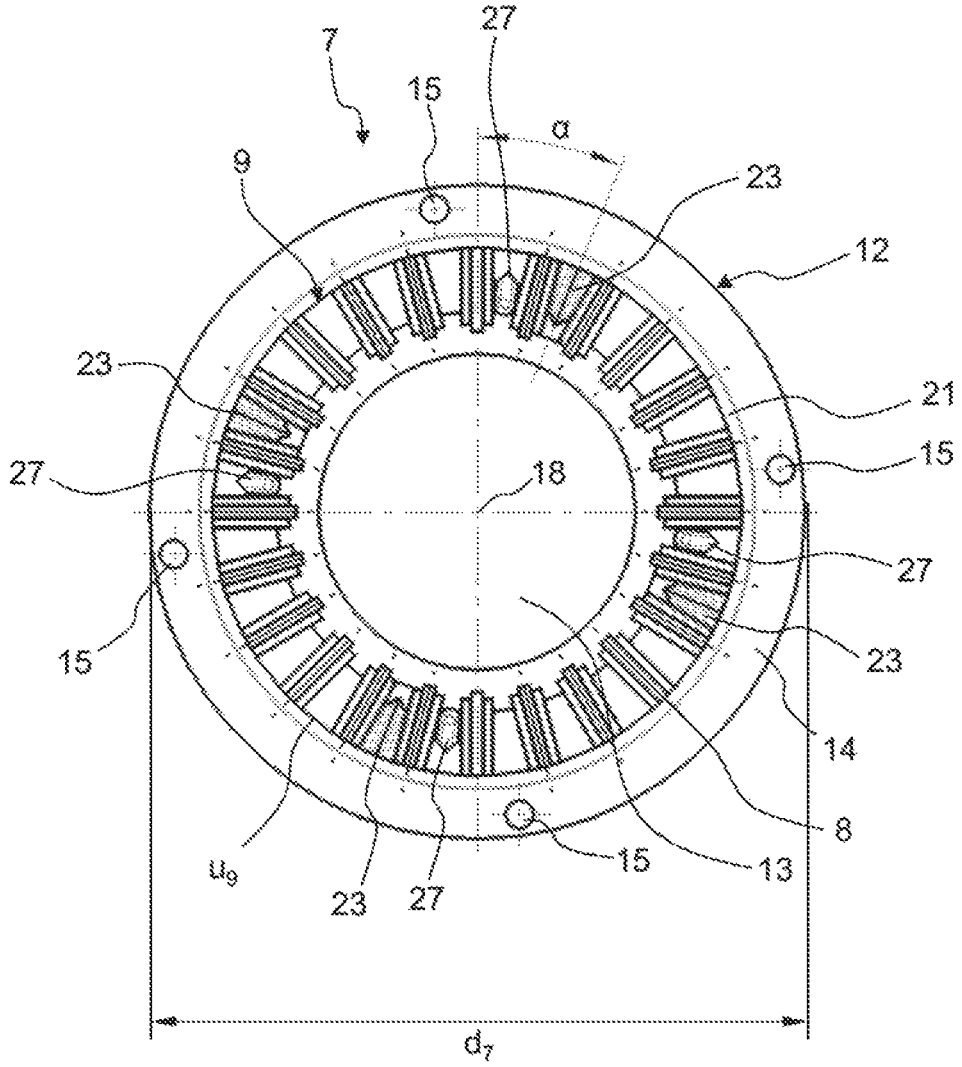
FIG. 2 shows a schematic top view of an embodiment of a burner cover for the gas burner according to FIG. 1.
Figure 3:
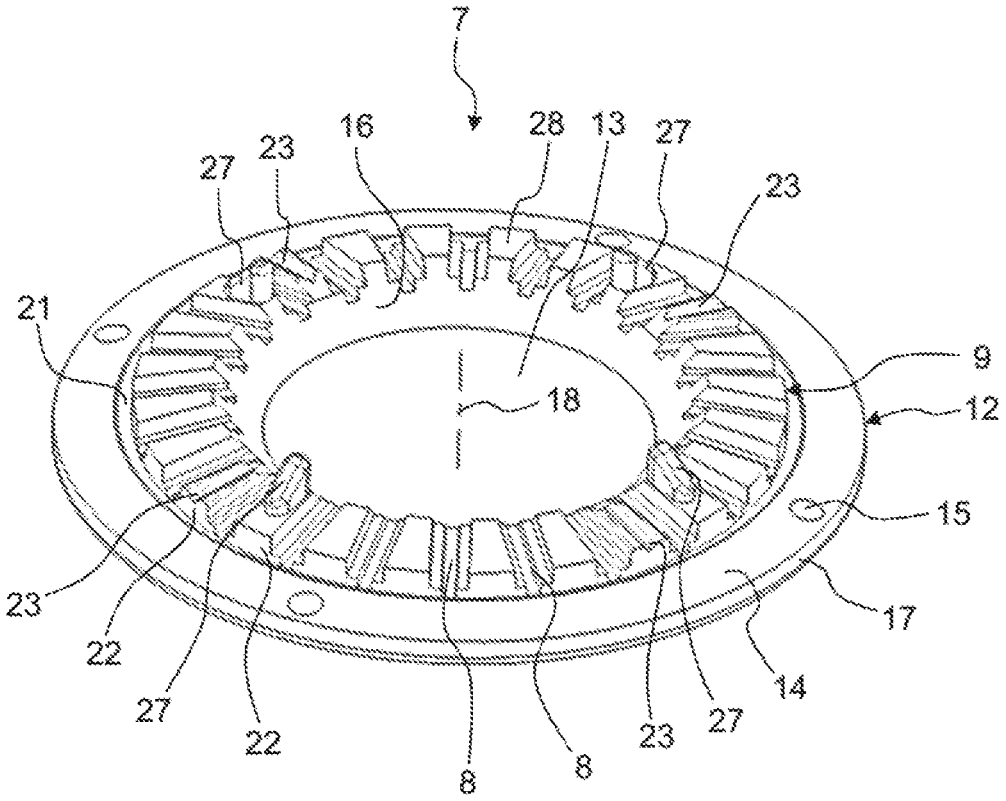
FIG. 3 shows a schematic perspective view of the burner cover according to FIG. 2.
Figure 4:
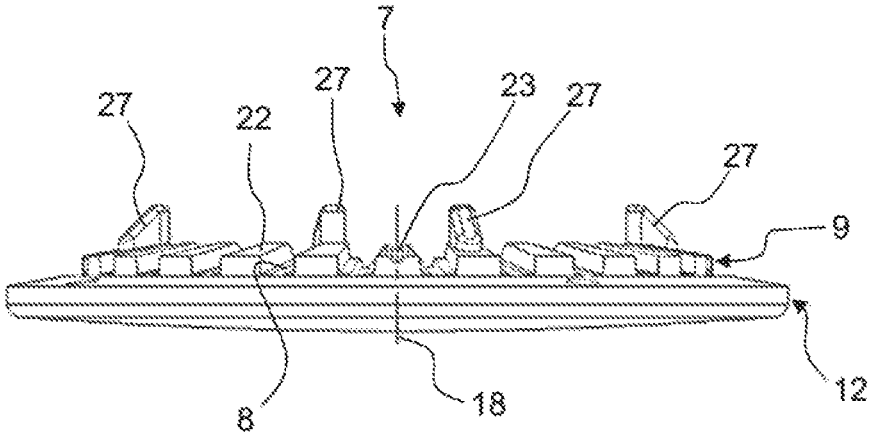
FIG. 4 shows a schematic lateral view of the burner cover according to FIG. 2.
Figure 5:
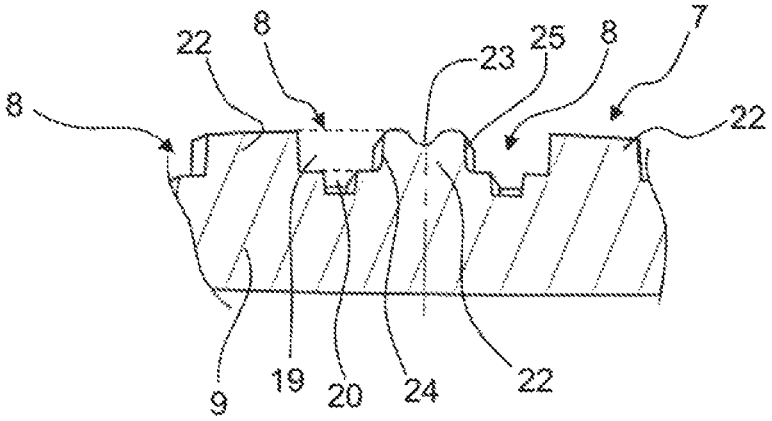
FIG. 5 shows an enlarged detail from the schematic lateral view of the burner cover according to FIG. 4.
Figure 6:
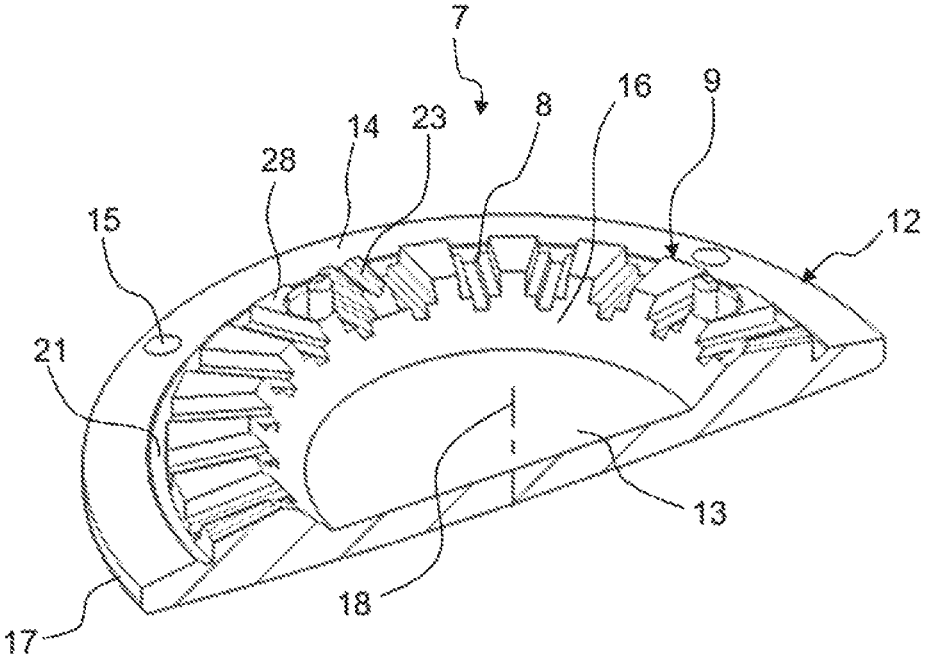
FIG. 6 shows a schematic perspective sectional view of the burner cover according to FIG. 2.
Figure 7:
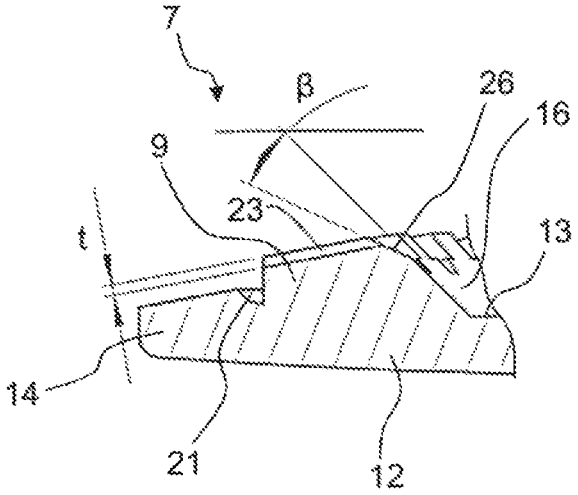
FIG. 7 shows an enlarged detail from the schematic sectional view of the burner cover according to FIG. 6.

FIG. 2 shows an embodiment of a burner cover 7 viewed from the top. FIG. 3 shows the burner cover 7 according to FIG. 2 in a perspective view. FIG. 4 shows the burner cover 7 according to FIG. 2 viewed from the side. FIG. 5 shows an enlarged sectional view of the burner cover 7 according to FIG. 4. FIG. 6 shows a schematic sectional view of the burner cover 7 according to FIG. 2 and FIG. 7 shows an enlarged sectional view of the burner cover 7 according to FIG. 6. Reference is made simultaneously to FIGS. 2 to 7 in the following.

The burner cover 7 has a disk-shaped base segment 12. The disk-shaped base segment 12 advantageously has a circular geometry. The annular gas distribution segment 9 is connected to the base segment 12. The annular gas distribution segment 9 surrounds a disk-shaped central section 13 of the base segment 12. An annular outer section 14 of the base segment 12, running around the outside of the gas distribution segment 9, is provided. Blind holes 15 can be provided in the outer section 14. As FIG. 2 shows, four blind holes 15 may be provided, which are arranged in pairs opposite one another. The outer section 14 and the gas distribution segment 9 are arranged concentrically to one another.

The gas distribution segment 9 comprises the first gas distribution channels 8. There can be any number of first gas distribution channels 8. As FIGS. 2 and 3 show, twenty-four first gas distribution channels 8 may be provided. The first gas distribution channels 8 extend radially from an inner surface 16 (FIG. 3) of the gas distribution segment 9 toward a peripheral outer edge 17 of the base segment 12. In particular, the first gas distribution channels 8 extend toward the outer section 14 of the base segment 12. The burner cover 7 has a central or symmetrical axis 18. Each first gas distribution channel 8 extends completely through the gas distribution segment 9.

As FIG. 5 shows, each first gas distribution channel 8 has a T-shaped cross-sectional geometry, which is open in the direction pointing away from the base segment 12. In particular, the first gas distribution channel 8 is open toward the upper edge 10 of the lower section 2 of the burner. This means that the first distribution channel 8 is closed in the figurative sense by the upper edge 10 of the lower section 2 of the burner to form a T-shaped gas outlet 11 (FIG. 1). As FIG. 5 further shows, the T-shaped cross-sectional geometry of each first gas distribution channel 8 has a horizontal section 19 and a vertical section 20. The horizontal section 19 is open in the direction pointing away from the base segment 12. The horizontal section 19 is preferably 1.5 to 6 times, more preferably 2 to 5 times, even more preferably 2.5 to 4 times as wide as the vertical section 20. The vertical section 20 extends into the gas distribution segment 9 preferably 1.5 to 6 times, more preferably 2 to 5 times, and even more preferably 2.5 to 4 times as deeply as the horizontal section 19 does.

The first gas distribution channels 8 are arranged so as to be evenly distributed around a periphery $u_9$ (FIG. 2) of the gas distribution segment 9. The inner surface 16 of the gas distribution segment 9, as FIG. 7 shows, is inclined obliquely to the base segment 12 and, in particular, obliquely to the central section 13 of the base segment 12. The first gas distribution channels 8 are inclined toward the outer edge 17 of the base segment 12. The burner cover 7 further has a circumferential groove 21 (FIG. 6, 7), which runs completely around the gas distribution segment 9. The circumferential groove 21 is advantageously designed to be quadrant-shaped. As FIG. 6 shows, the vertical sections 20 of the first gas distribution channels 8 open into the circumferential groove 21. The horizontal sections 19 of the first gas distribution channels 8 are positioned so that they are arranged above the circumferential groove 21. The first gas distribution channels 8 are separated from one another by bridges 22 (FIG. 5).

As FIG. 5 shows, the burner cover 7 furthermore has second gas distribution channels 23, which extend radially from the inner surface 16 of the gas distribution segment 9 toward the outer edge 17 of the base segment 12. Each second gas distribution channel 23 extends completely through the gas distribution segment 9 and has a semi-circular cross-sectional geometry, which is open in the direction pointing away from the base segment 12. A gas outlet of the second gas distribution channels 23 is defined by the open semi-circular geometry of the second gas distribution channels 23 and the upper edge 10 of the lower section 2 of the burner. Each second gas distribution channel 23 extends through a bridge 22 of the gas distribution segment 9, said bridge being provided between two first gas distribution channels 8. The number of second gas distribution channels 23 is advantageously smaller than the number of first gas distribution channels 8. For example, four second gas distribution channels 23 are provided, as shown in FIGS. 2 and 3. The second gas distribution channels 23 are preferably arranged so as to be evenly distributed around the periphery $u_9$ of the gas distribution segment 9. In particular, in each case two second gas distribution channels 23 are positioned opposite one another.

As FIG. 2 shows, a second gas distribution channel 23 may be rotated around an angle $\alpha$ in relation to a horizontally arranged first gas distribution channel 8. The angle $\alpha$ may, for example, be 22.5°. As FIG. 5 shows, each second gas distribution channel 23 is arranged between two first gas distribution channels 8. Side walls 24, 25 of two first gas distribution channels 8 facing the second gas distribution channel 23 are advantageously designed in a rounded fashion.

As FIG. 7 shows, an inflow surface 26 of each second gas distribution channel 23 is inclined by an angle $\beta$ in relation to the inner surface 16 of the gas distribution segment 9. This enables the fuel gas/air mixture to flow better into the second gas distribution channels 23. The angle $\beta$ may for example be 20°. A depth t of the second gas distribution channel 23 is 0.5 mm, for example.

The burner cover 7, as shown for example in FIG. 6, furthermore has positioning elements 27 for positioning the burner cover 7 over the lower section 2 of the gas burner 1. The positioning elements 27 extend from the gas distribution segment 9 in the direction pointing away from the base segment 12. An upper surface 28 of the gas distribution segment 9 is inclined toward the outer edge 17 of the base segment 12. The gas distribution channels 8, 23 are positioned parallel to the upper surface 28 and likewise run outward from the central section 13 toward the outer section 14 obliquely to the outer section 14.

The positioning elements 27 are arranged on the inclined upper surface 28. The positioning elements 27 are in particular wedge-shaped and inclined toward the outer edge 17 of the base segment 12. The wedge-shaped geometry of the positioning elements 27 enables the burner cover 7 to be centered over the lower section 2 of the burner. Receiving sections are preferably provided in the lower section 2 of the burner for receiving the positioning elements 27. The positioning elements 27 are arranged so as to be evenly distributed around the periphery $u_9$ of the gas distribution segment 9 and positioned opposite one another in pairs. As FIGS. 2 and 3 show, the positioning elements 27 are preferably arranged on bridges 22 of the gas distribution segment 9 which are arranged adjacently to a bridge 22 with a second gas distribution channel 23.

The burner cover 7 or burner base segment 12 has an outer diameter $d_7$ (FIG. 2). With the help of the first gas distribution channels 8 and the gas distribution segment 9, a fuel gas delivered into a mixing space provided between the burner cover 7 and the lower section 2 of the burner is mixed evenly with primary air and distributed evenly around the periphery $u_9$ of the gas distribution segment 9, wherein the first gas distribution channels 8 define the gas flow rate for the normal use of the gas burner 1. A particularly stable burner flame is achieved in this due to the T-shaped cross-sectional geometry of the first gas distribution channels 8. The T-shaped geometry of the first gas distribution channels 8 enables the air/fuel gas-mixture to flow out particularly evenly.

The second gas distribution channels 23, one of which is arranged immediately adjacent to the ignition element 3, improve the ionization during ignition and facilitate fast and reliable ignition even at high temperatures, with low pressure and if the burner cover 7 is soiled. Due to the smaller cross-sectional geometry of the second gas distribution channels 23, the gas flows out of them more quickly.

With the help of the positioning element 27 the burner cover 7 can be positioned in a correct position relative to the lower section 2 of the burner. In particular, this enables a second gas distribution channel 23 to be positioned at an ignition element 3. The modification of the cross-sectional geometry of the gas distribution channels 8, 23 enables the height of the burner cover 7 and thus the height of the gas burner 1 to be reduced. At the same time the efficiency of the gas burner 1 is increased. Moreover, the height of the container support can be reduced, which means that the gas cooktop can be constructed with a lower height. Because the gas distribution channels 8, 23 run obliquely from the inner surface 16 of the gas distribution segment 9 toward the outer edge 17 of the base segment 12, an optimized burner flame angle can be achieved. The partial extinguishing of the burner flame is prevented in order to minimize carbon monoxide emissions.

Figure 8:
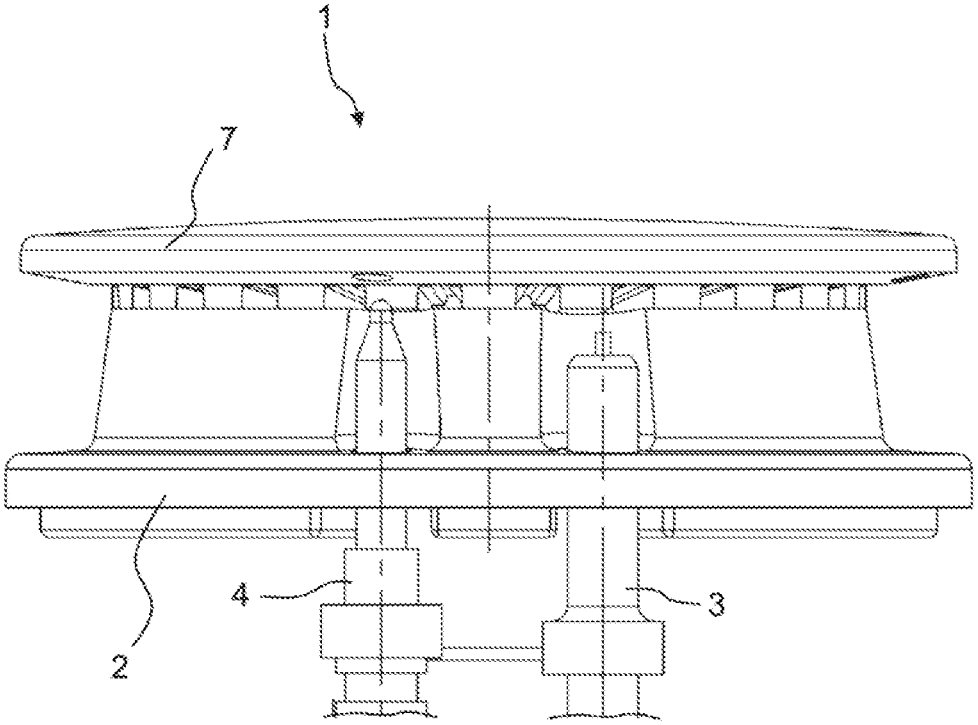
FIG. 8 shows a schematic lateral view of a further embodiment of a gas burner.
Figure 9:
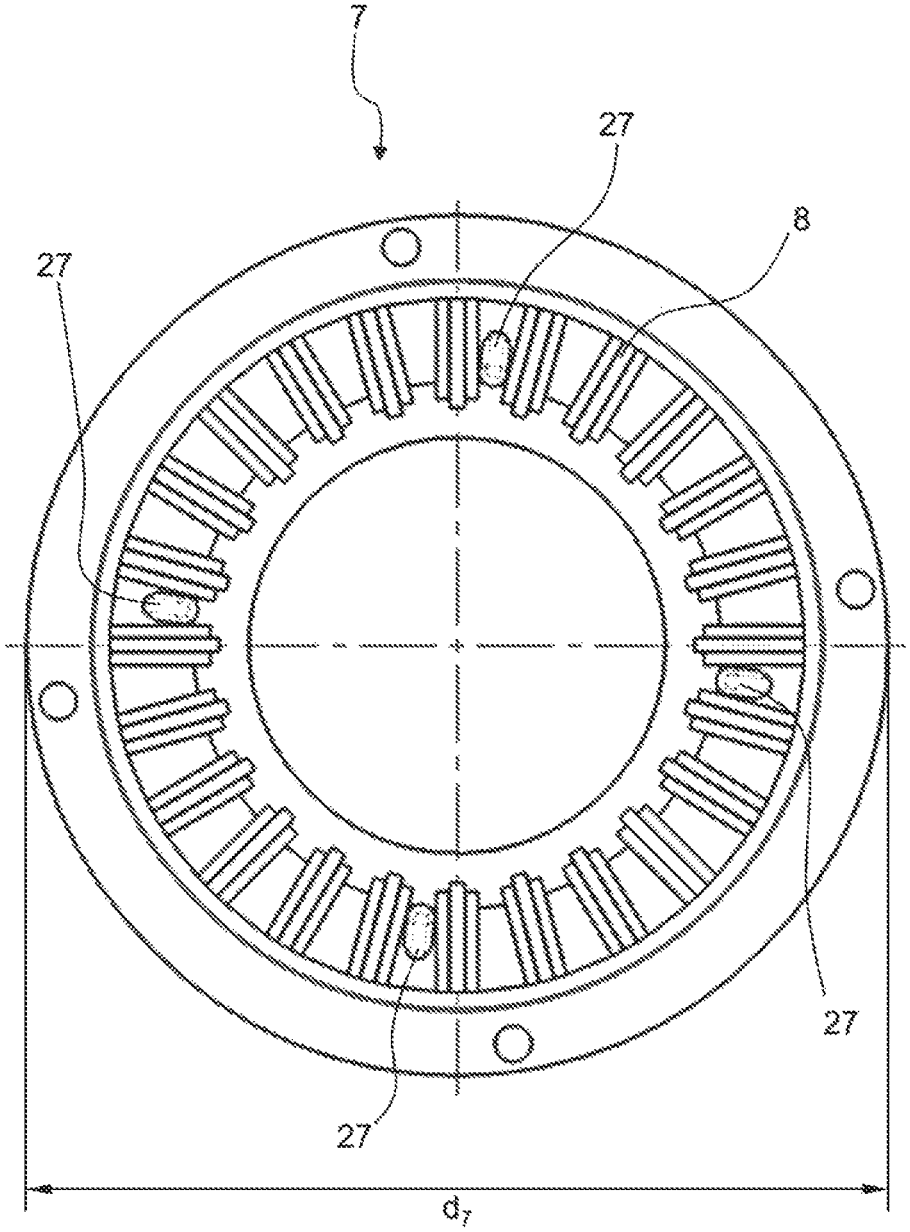
FIG. 9 shows a schematic top view of an embodiment of a burner cover for the gas burner according to FIG. 8.
Figure 10:
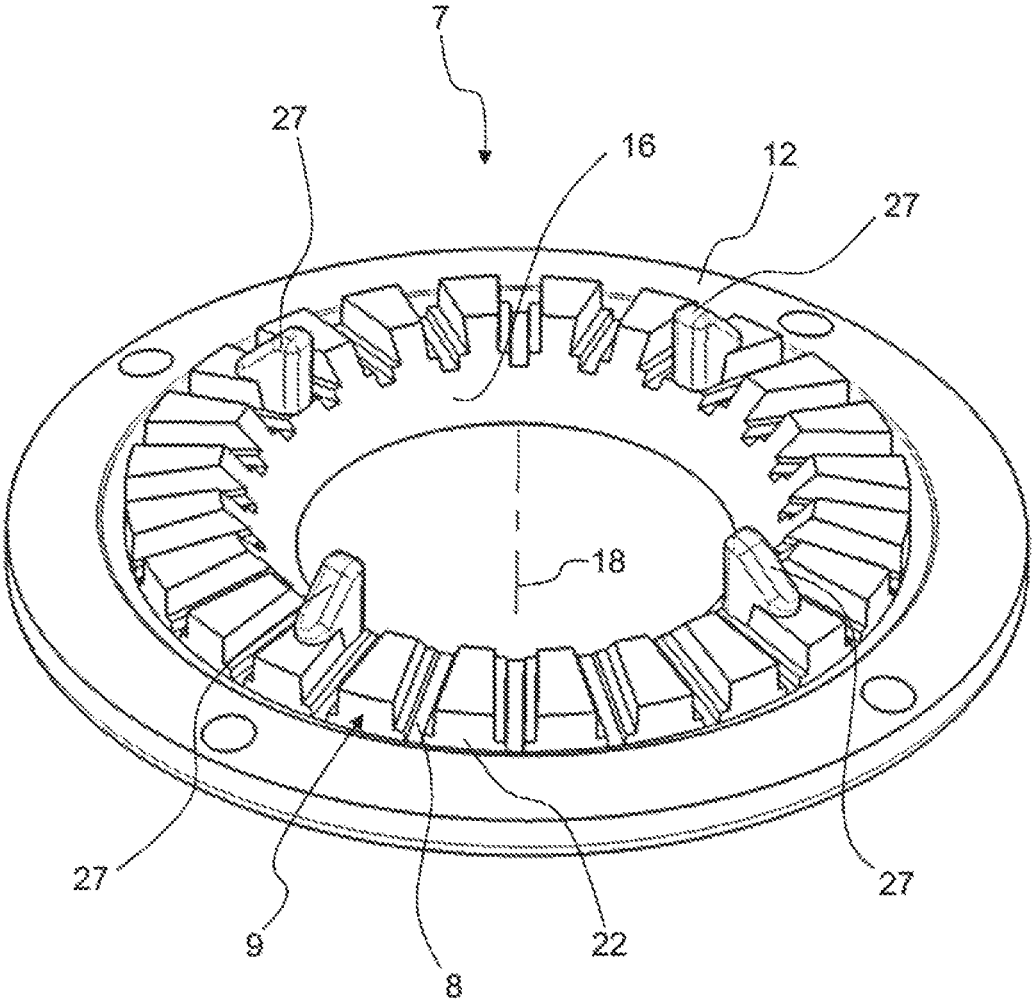
FIG. 10 shows a schematic perspective view of the burner cover according to FIG. 9.
Figure 11:
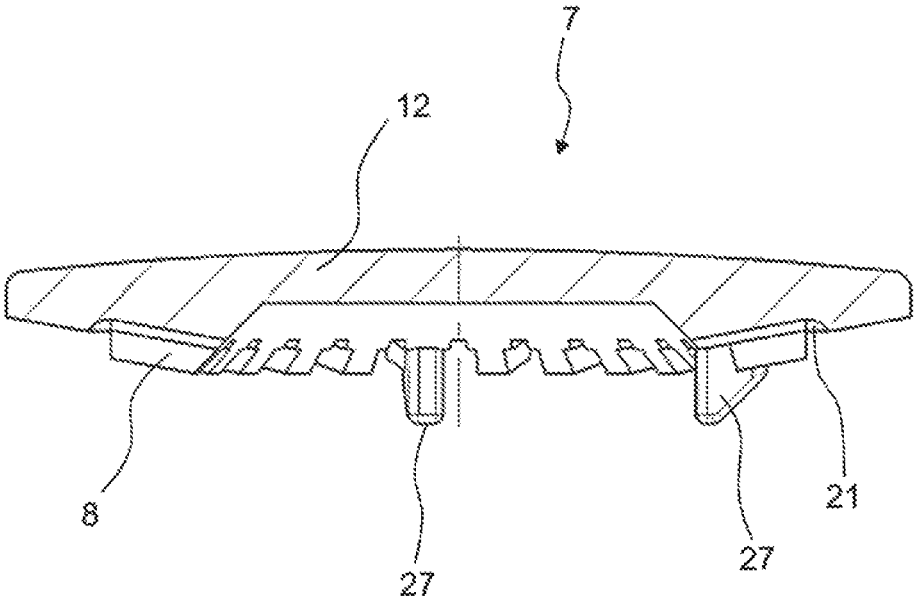
FIG. 11 shows a schematic sectional view of the burner cover according to FIG. 9.

FIG. 8 is a schematic lateral view showing a further embodiment of a gas burner 1. FIG. 9 is a schematic top view showing an embodiment of a burner cover 7 for the gas burner 1 according to FIG. 8. FIG. 10 is a perspective view showing the burner cover 7. FIG. 11 is a schematic sectional view showing the burner cover 7. Reference is made simultaneously to FIGS. 8 to 11 in the following.

The gas burner 1 has a lower section 2 and a burner cover 7. The gas burner 1 according to FIG. 8 differs from the gas burner 1 according to FIG. 1 in that it has a higher rated output. In particular, the burner cover 7 has a larger diameter $d_7$ than the burner cover 7 according to FIG. 2. The number of first gas distribution channels 8 may correspond therein to the number of first gas distribution channels 8 of the burner cover 7 according to FIG. 2. Second gas distribution channels 23 are not shown in FIGS. 9 to 11.

Figure 12:
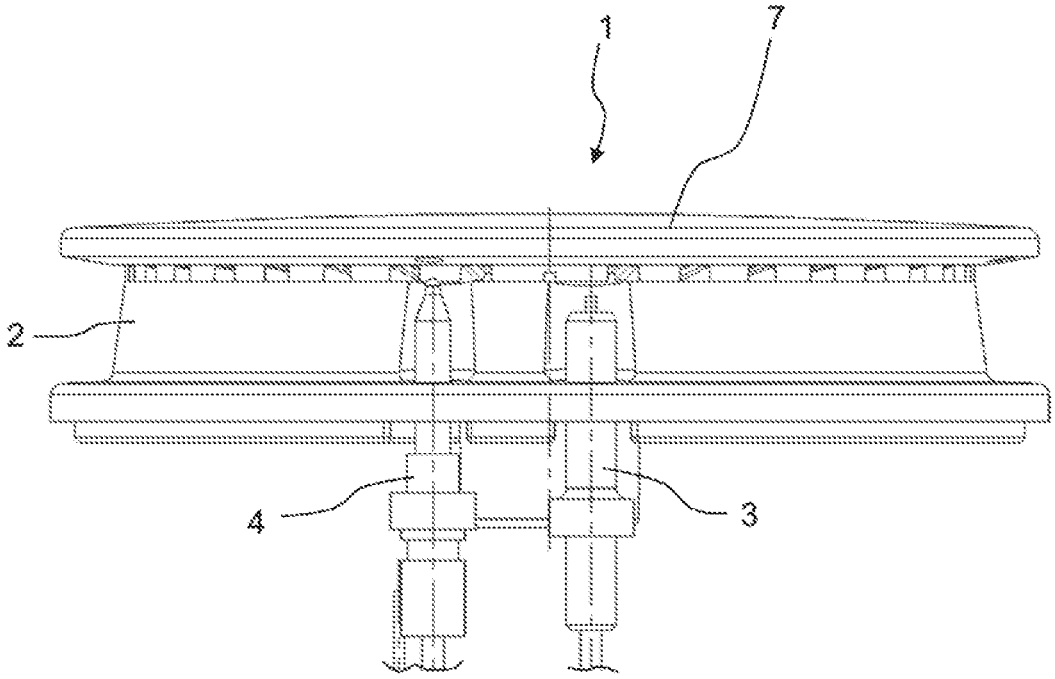
FIG. 12 shows a schematic lateral view of a further embodiment of a gas burner.
Figure 13:
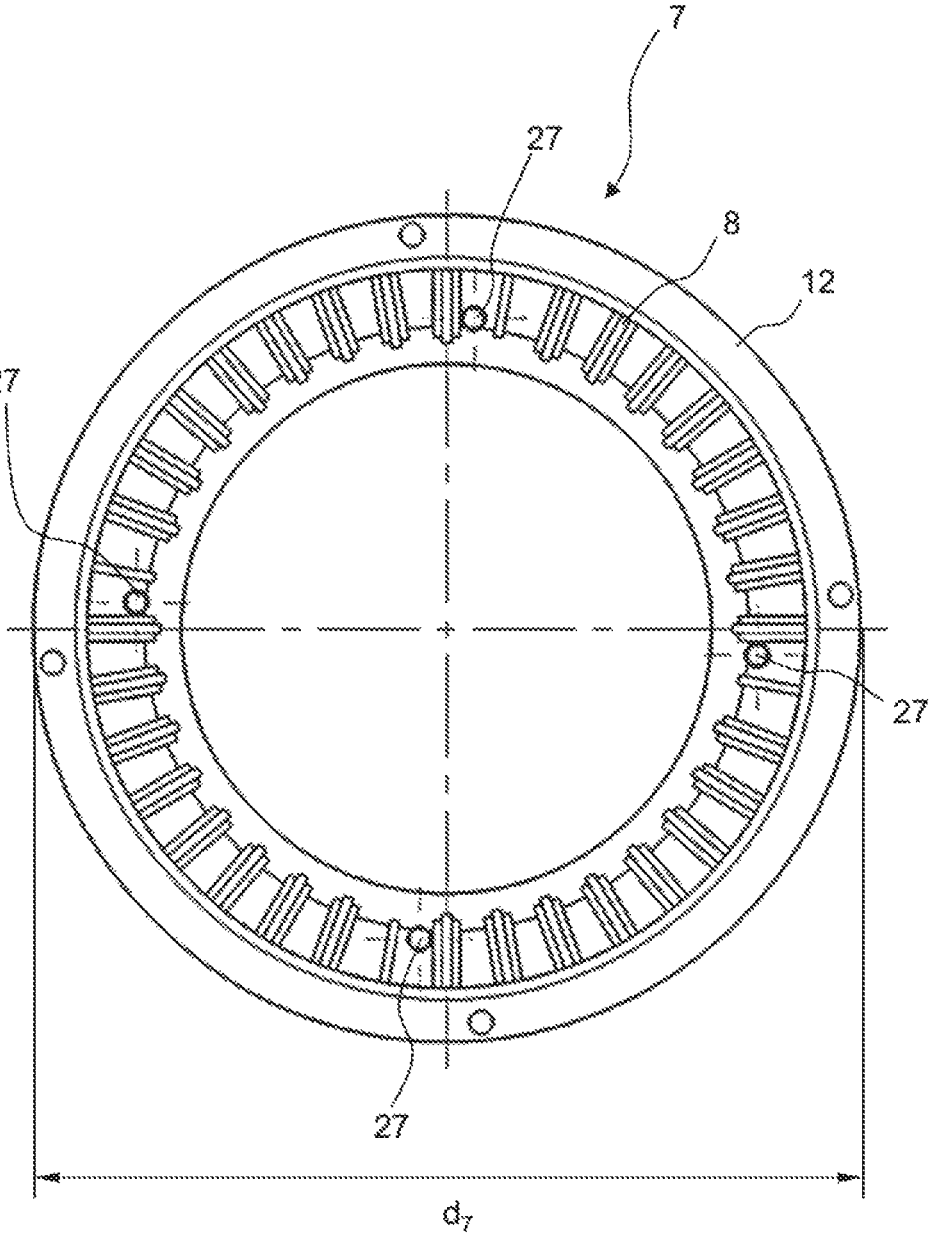
FIG. 13 shows a schematic top view of an embodiment of a burner cover for the gas burner according to FIG. 12.
Figure 14:
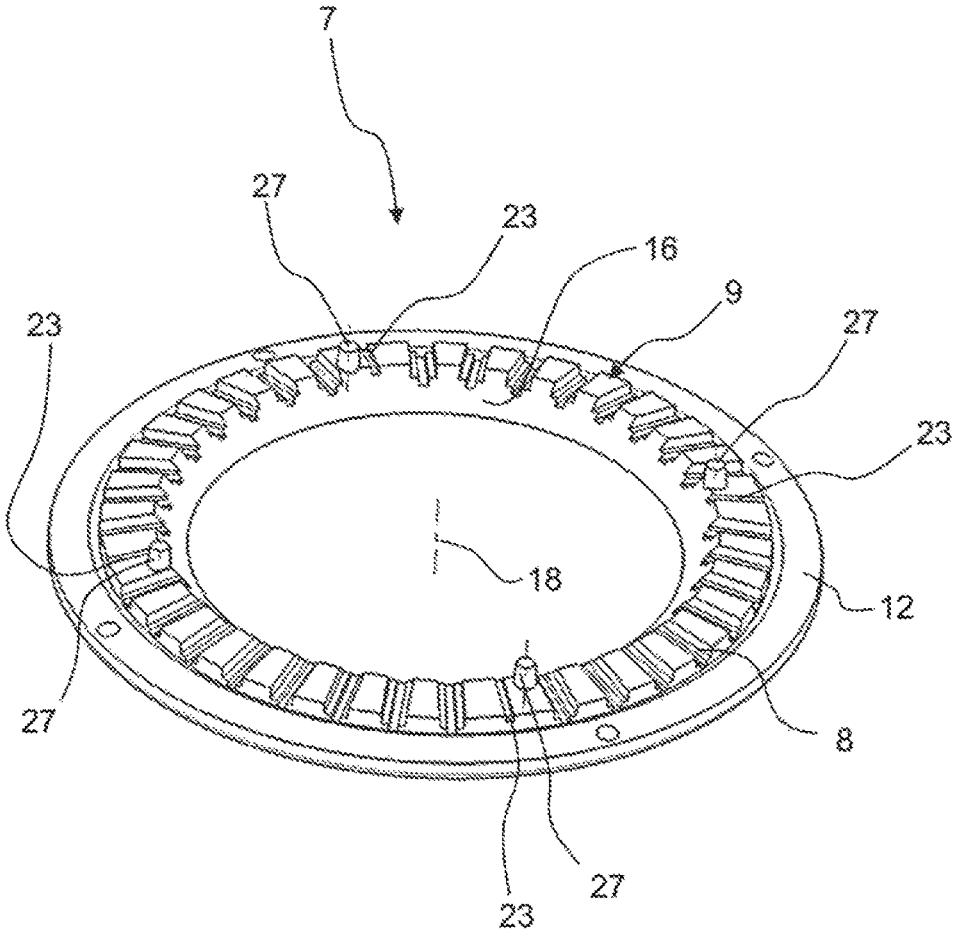
FIG. 14 shows a schematic perspective view of the burner cover according to FIG. 12.
Figure 15:
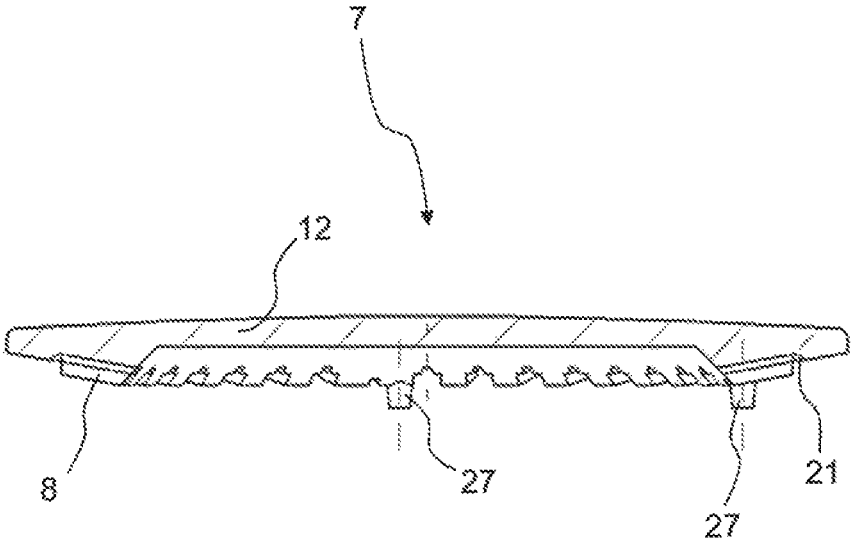
FIG. 15 shows a schematic sectional view of the burner cover according to FIG. 12.

FIG. 12 is a schematic lateral view showing a further embodiment of a gas burner 1. FIG. 13 is a schematic top view showing an embodiment of a burner cover 7 for the gas burner 1 according to FIG. 12. FIG. 14 is a perspective view showing the burner cover 7. FIG. 15 is a schematic sectional view showing the burner cover 7. Reference is made simultaneously to FIGS. 12 to 15 in the following.

The gas burner 1 according to FIG. 12 differs from the gas burner 1 according to FIG. 8 in that it has a higher rated output. The gas burner 1 has a lower section 2 and a burner cover 7. The diameter $d_7$ of the burner cover 7 according to FIG. 13 is larger than the diameter $d_7$ of the burner cover 7 according to FIG. 9. The burner cover 7 according to FIG. 13 has a higher number of first gas distribution channels 8. The burner cover 7 further differs from the burner cover 7 according to FIG. 2 in that the positioning elements 27 are not wedge-shaped, but frusto-conically shaped.

Positioning the burner cover 7 in relation to the lower section 2 of the burner with the help of positioning elements 27 enables the relative position of the ignition element 3 in relation to a second gas distribution channel 23 to be exactly defined. The ignition is improved as a result. The novel T-shaped geometry of the first gas distribution channels 8 enables the height of the burner cover 7 to be reduced. This means that the gas burner 1 may have flatter dimensions yet with the same or superior efficiency. In particular, the gas burner 1 may be easily covered with a container support or cooking grid. The geometry of the gas distribution channels 8, 23 thus permits the height of the gas burner 1 to be reduced while achieving improved efficiency. Because the gas distribution channels 8, 23 run obliquely upward toward the outer section 14 of the base segment 12, an improved burner flame angle can be achieved. This also improves the efficiency of the gas burner 1. As well as the reduction in the height of the gas burner 1, the diameter $d_7$ of the burner cover 7 can also be increased. The increased diameter $d_7$ results in improvements in flame distribution and flame stability.

The invention claimed is:

1. A burner cover for a gas burner, said burner cover comprising:

a disk-shaped base segment, an annular gas distribution segment connected to the base segment, said gas distribution segment comprising first gas distribution channels, which extend radially from an inner surface of the gas distribution segment toward an outer edge of the base segment, each said first gas distribution channel extending through the gas distribution segment and having a T-shaped cross-sectional geometry, which is open in a direction pointing away from the base segment, and a second gas distribution channels, which extend radially from the inner surface of the gas distribution segment toward the outer edge of the base segment, each said second gas distribution channel extending through the gas distribution segment and having a semi-circular cross-sectional geometry, which is open in a direction pointing away from the base segment.

2. The burner cover of claim 1, wherein the T-shaped cross-sectional geometry has a horizontal section and a vertical section, said horizontal section being open in a direction pointing away from the base segment.

3. The burner cover of claim 1, wherein the horizontal section is 1.5 to 6 times as wide as the vertical section.

4. The burner cover of claim 1, wherein the horizontal section is 2 to 5 times as wide as the vertical section.

5. The burner cover of claim 1, wherein the horizontal section is 2.5 to 4 times as wide as the vertical section.

6. The burner cover of claim 1, wherein the vertical section extends into the gas distribution segment 1.5 to 6 times as deeply as the horizontal section.

7. The burner cover of claim 1, wherein the vertical section extends into the gas distribution segment 2 to 5 times as deeply as the horizontal section.

8. The burner cover of claim 1, wherein the vertical section extends into the gas distribution segment 2.5 to 4 times as deeply as the horizontal section.

9. The burner cover of claim 1, wherein the first gas distribution channels are arranged so as to be evenly distributed around a periphery of the gas distribution segment.

10. The burner cover of claim 1, wherein the inner surface of the gas distribution segment is inclined obliquely to the base segment.

11. The burner cover of claim 1, wherein the base segment includes a circumferential groove in surrounding relation to the gas distribution segment.

12. The burner cover of claim 1, further comprising positioning elements for positioning the burner cover on a lower section of the gas burner, said positioning elements extending out of the gas distribution segment in a direction pointing away from the base segment.

13. The burner cover of claim 12, wherein the positioning elements are arranged so as to be evenly distributed around a periphery of the gas distribution segment, and wherein the positioning elements are positioned opposite one another in pairs.

14. The burner cover of claim 12, wherein the positioning elements are wedge-shaped.

15. The burner cover of claim 1, wherein the gas distribution segment has an upper surface which is inclined toward the outer edge of the base segment.

16. The burner cover of claim 1, wherein each second gas distribution channel extends through a bridge of the gas distribution segment, said bridge being provided between two of the first gas distribution channels.

17. The burner cover of claim 1, wherein the second gas distribution channels are arranged so as to be evenly distributed around a periphery of the gas distribution segment and positioned opposite one another in pairs.

* * * * *